US007052083B2

(12) United States Patent
Peitz et al.

(10) Patent No.: US 7,052,083 B2
(45) Date of Patent: May 30, 2006

(54) BUMPER EDGE CHAIR

(75) Inventors: Timothy V. Peitz, Petersburg, MI (US); Phillip P. Swy, Temperance, MI (US); Chuck Stahl, Erie, MI (US)

(73) Assignee: MTS Burgess, Temperance, MI (US)

( * ) Notice: Subject to any disclaimer, the term of this patent is extended or adjusted under 35 U.S.C. 154(b) by 0 days.

(21) Appl. No.: 10/837,469

(22) Filed: Apr. 30, 2004

(65) Prior Publication Data

US 2005/0242651 A1 Nov. 3, 2005

(51) Int. Cl.
*A47C 31/00* (2006.01)

(52) U.S. Cl. ..... 297/183.1; 297/463.1; 297/239; 297/463.2

(58) Field of Classification Search ..... 297/183.1, 297/239, 183.6, 218.1, 218.5, 218.3, 218.2, 297/218.4, 463.1, 463.2, 183.7; 248/345.1; 16/110.1, 426, 422, 413
See application file for complete search history.

(56) References Cited

U.S. PATENT DOCUMENTS 2,233,694 A * 3/1941 Cramer et al. ..... 5/402
2,538,634 A * 1/1951 Vogelsang ..... 248/345.1
3,671,074 A * 6/1972 Bergstrom ..... 297/239
3,708,202 A * 1/1973 Barecki et al. ..... 297/239
3,712,003 A * 1/1973 Hallock et al. ..... 52/254
4,018,479 A * 4/1977 Ball ..... 297/452.19
4,106,739 A * 8/1978 Gasser ..... 248/345.1
4,639,042 A * 1/1987 Lange ..... 297/440.2
4,653,803 A * 3/1987 Crowe ..... 297/452.18
5,064,247 A * 11/1991 Clark et al. ..... 297/447.3
5,248,186 A * 9/1993 Steinfeld et al. ..... 297/452.1
5,271,662 A * 12/1993 Saul ..... 297/219.1
5,762,396 A * 6/1998 Barile ..... 297/239
6,009,073 A * 12/1999 Kaneko ..... 370/203
6,106,061 A * 8/2000 Caruso et al. ..... 297/239
6,125,488 A * 10/2000 Vogland et al. ..... 5/739
6,174,029 B1 * 1/2001 Swy ..... 297/448.1
6,708,941 B1 * 3/2004 Bowen et al. ..... 248/345.1

* cited by examiner

*Primary Examiner*—Anthony D. Barfield
*Assistant Examiner*—Erika Garrett
(74) *Attorney, Agent, or Firm*—Gifford, Krass, Groh, Sprinkle, Anderson & Cikowski, PC

(57) ABSTRACT

A chair includes a seat back having a generally rigid back member. The rigid member includes a peripheral edge. The peripheral edge is defined by spaced apart sides and top and bottom edges extending between the sides. A handle is fixedly secured to the top edge of the seat back. The handle extends between opposite ends. A bumper extends along at least a portion of the peripheral edge. The bumper has at least one end that abuts one of the ends of the handle to provide a smooth transition between the handle and the bumper.

21 Claims, 4 Drawing Sheets

BUMPER EDGE CHAIR

FIELD OF THE INVENTION

The present invention relates generally to chairs. More specifically, the invention relates to an improved stacking chair with a seat back having a bumper edge.

BACKGROUND OF THE INVENTION

Chairs for extended seating applications, such as banquet halls and conference rooms, are preferably comfortable, durable, and either stackable or nestable for storage purposes. Traditional stackable banquet chairs include a pair of inverted-U-shaped leg members attached to opposite sides of a generally horizontal seat cushion. A generally L-shaped back support frame interconnects with the leg members and extends upwardly from the rear of the seat cushion to support a seat back. This type of chair may be stacked by placing the inverted-U-shaped leg members of one chair over the top of the leg members of another chair, such that the seat of the upper chair is supported just above the seat of the lower chair. Examples of traditional stackable banquet chairs are shown in U.S. Pat. No. 3,102,733 to Burnett and U.S. Design Pat. No. D180,996 to Cramer.

It is known to provide a rigid handle at the top of the seat back to facilitate carrying or moving of the chair. It remains desirable to provide an bumper or cover that extends around at least a portion of the perimeter of the seat back that prevents damage when the seat back is moved against a table, while at the same time maintaining a desirable aesthetic appearance.

SUMMARY OF THE INVENTION

A chair is provided according to one aspect of the invention. The chair includes a seat back. The seat back includes a generally rigid back member having a peripheral edge. The peripheral edge is defined by spaced apart sides and top and bottom edges extending between the sides. A handle is fixedly secured to the top edge of the seat back. The handle extends between opposite ends. A bumper extends along at least a portion of the peripheral edge. The bumper has at least one end that abuts one of the ends of the handle to provide a smooth transition between the handle and the bumper.

DETAILED DESCRIPTION OF THE PREFERRED EMBODIMENTS

Figure 1:
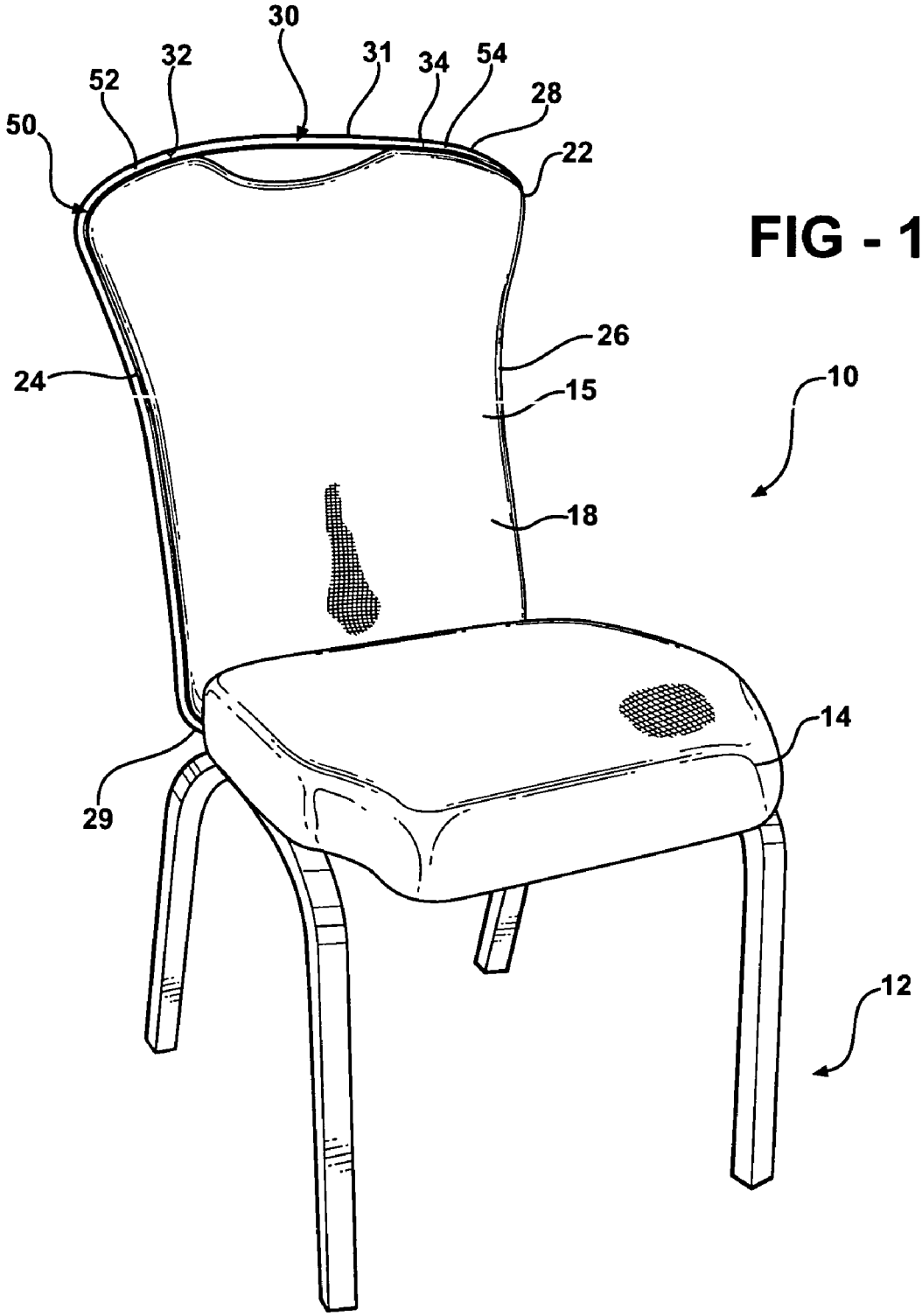
FIG. 1 is a frontal perspective view of a chair according to the present invention.
Figure 2:
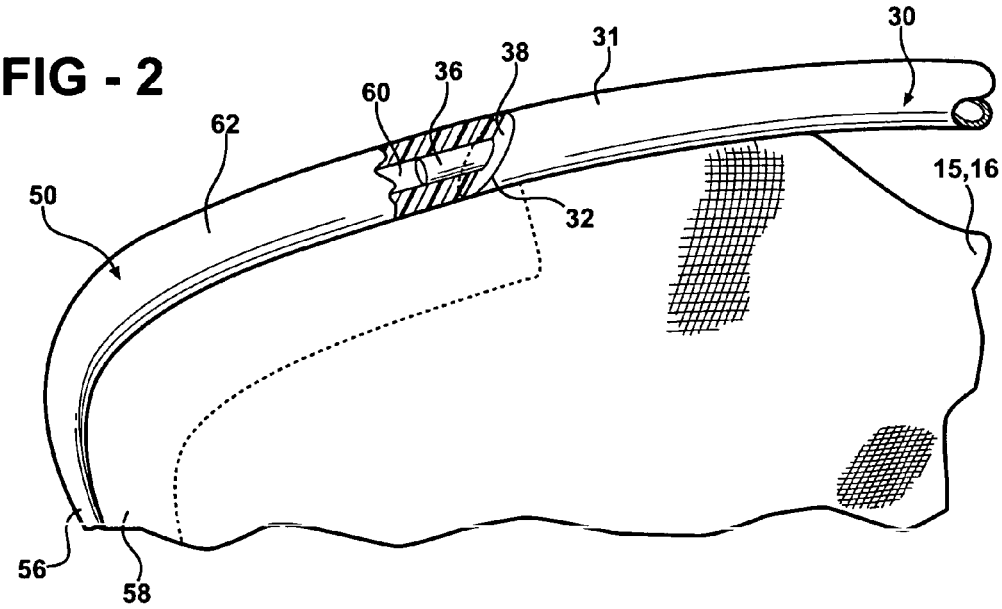
FIG. 2 is a partial perspective view of a seat back of the chair according to the invention.

A chair according to one embodiment of the invention is generally indicated at 10 in FIGS. 1 through 3B. The chair

10 includes a base 12 that supports a seat cushion 14 in a generally horizontal position. A seat back 15 is fixedly secured to a rear edge of the seat cushion 14 and extends generally upwardly therefrom. The seat back 15 includes a generally rectangular rigid back member 16 having opposite front 18 and rear 20 sides. Preferably, the back member 16 is made of wood or similar material. Each of the front 18 and rear 20 sides of the back member 16 extend between a peripheral edge 22. The peripheral edge 22 defines spaced apart sides 24, 26 and a top 28 and bottom 29 edge extending therebetween. A handle 30 is fixedly secured to and disposed longitudinally along the top edge 28 of the back member 16. The handle 30 includes an outer surface 31 extending between opposite ends 32, 34. Each end 32, 34 of the handle 30 includes a nub or reduced width portion 36. An abutment surface 38 is defined by the difference in diameter between the handle 30 and the reduced width portion 36. A foam pad 40 encased in a textile trim cover 42, as commonly known by those skilled in the art, is fixedly secured to the back member 16.

Figure 3A:
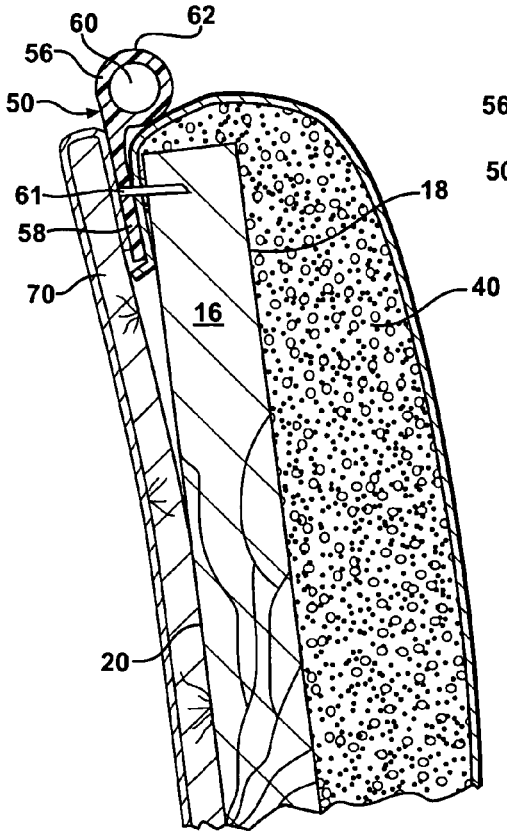
FIG. 3A is a cross sectional view of a top portion of the seat back according to the invention.
Figure 3B:
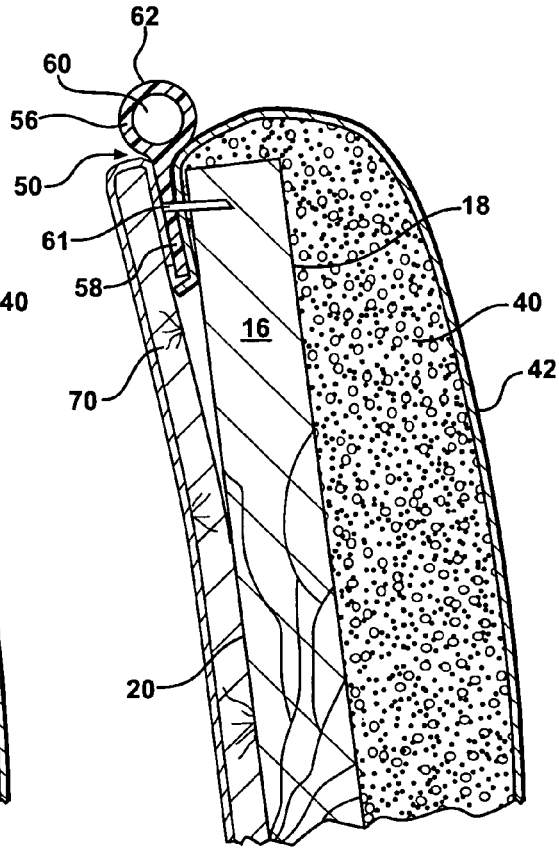
FIG. 3B is a cross sectional view of a top portion of the seat back with an alternative bumper shape.

A flexible bumper 50 extending between opposite ends 52, 54 is fixedly secured to the back member 16 for concealing the attachment of the trim cover 42 about the peripheral edge 22. The bumper is preferably an extended clear vinyl that is resilient, though other colors and materials may be used. As best shown in FIGS. 3A and 3B, the bumper 50 includes an extruded cross section defined by a body 56 and a flange 58 extending outwardly from the body 56. The body 56 includes an aperture 60 for receiving the reduced width portion 36 therein. The body 56 also includes an outer surface 62. A plurality of fasteners 61, such as staples or nails, are inserted through the flange 58 and into the rear side 20 of the back member 16, thereby fixedly attaching the bumper 50 to the back member 16. In FIG. 3A, the body 56 is generally offset relative to the flange 58 in a direction generally transverse to the flange 58. In FIG. 3B, the body 56 is centered relative to the flange 58.

In assembly, the bumper 50 is disposed along the sides 24, 26 and top 28 and bottom 29 edges of the back member 16. The reduced width portions 36 are received in the apertures 60 to allow the ends 52, 54 of the bumper to abut the abutment surfaces 38 of the ends 32, 34 of the handle 30 to provide a smooth transition between the outer surface 31 of the handle 30 and the outer surface 62 of the body 56. The widths and cross sections of the outer surfaces 31, 62 are substantially the same, which also helps to provide a smooth transition between the handle 30 and the bumper 50. The bumper 50 can also be made from two separate pieces, wherein each piece of the bumper 50 extends along respective sides 24, 26 and one end of each piece abuts the abutment surface 38 of the handle 30. A back panel 70 is fixedly secured to the back member 16. The back panel 70 conceals the back member 16, the flange 58 of the bumper 50, and the edges of the edges of the foam pad 40 and trim cover 42.

Figure 4:
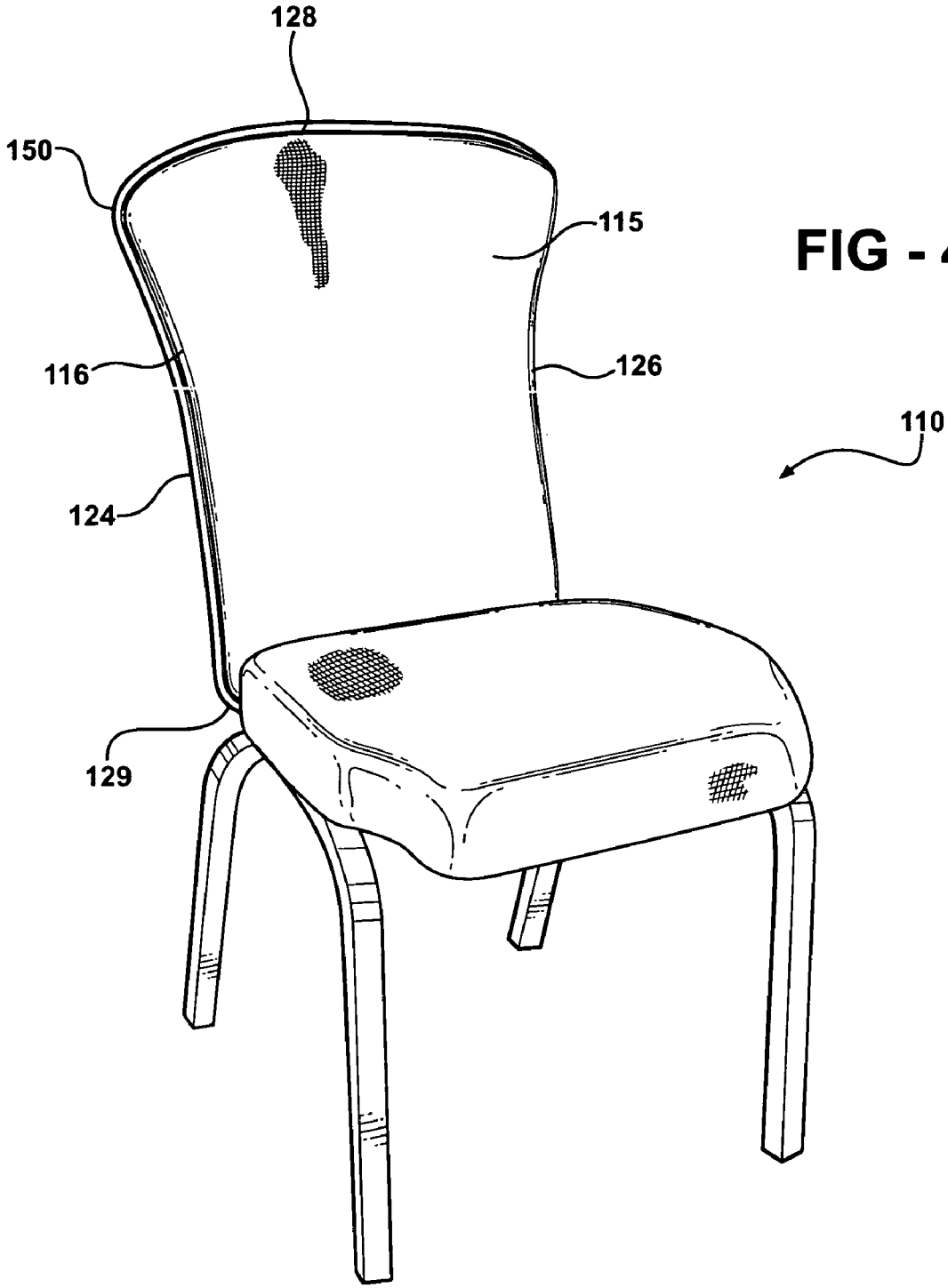
FIG. 4 is a frontal perspective view of the chair according to a second embodiment of the invention.
Figure 5:
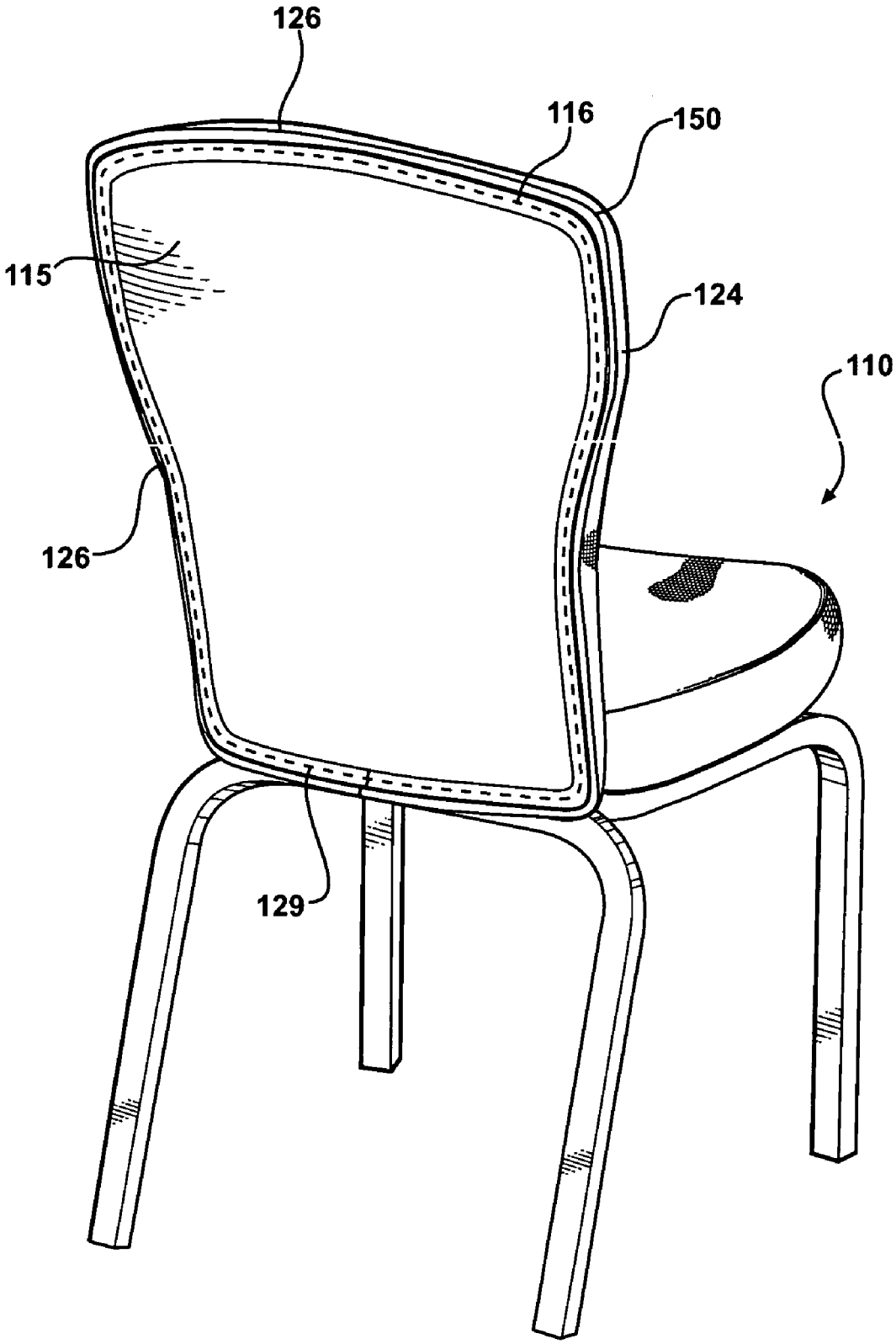
FIG. 5 is a rear perspective view of the chair according to the second embodiment of the invention.

Referring to FIGS. 4 and 5, an alternative embodiment of the chair is generally indicated at 110, wherein like parts are indicated by reference numerals offset by 100. This alternative embodiment of the chair 110 does not include a handle at the top of the seat back 115, as provided in the first embodiment. Instead, the bumper 150 extends continuously along the sides 124, 126 and top 128 and bottom 129 edges of the back member 116.

As will be clear to those of skill in the art, the herein-described embodiments of the present invention may be altered in various ways without departing from the scope or teaching of the present invention. For example, the handle and bumper may have non-circular cross sections, though it is preferred that they match each other. Also, other back shapes may be provided. It is the following claims, including all equivalents, which define the scope of the present invention.

I claim:

1. A chair comprising:

a seat back including a generally rigid back member having a peripheral edge, the peripheral edge defined by spaced apart sides and top and bottom edges extending between the sides;

a handle fixedly secured to the top edge of the seat back, the handle extending generally along the peripheral edge between opposite ends, the handle including an outer surface and a reduced width portion defined at each end of the handle, wherein portions of the handle adjacent to the ends have a smaller diameter than the outer surface of the handle, an abutment surface being defined due to the difference in diameter between the outer surface and reduced width portion;

a bumper that extends along at least a portion of the peripheral edge, the bumper having at least one end that abuts one of the ends of the handle to provide a smooth transition between the handle and the bumper.

2. A chair as set forth in claim 1, wherein the bumper includes a cross section defined by a body having an aperture for receiving the reduced width portion of the handle therein such that the ends of the bumper abut the abutment surface of the handle to provide a smooth transition between the handle and the bumper.

3. A chair comprising:

a seat back including a generally rigid back member having a peripheral edge, the peripheral edge defined by spaced apart sides and top and bottom edges extending between the sides;

a handle fixedly secured to the top edge of the seat back, the handle extending generally along the peripheral edge between opposite ends;

a bumper that extends along at least a portion of the peripheral edge, the bumper having at least one end that abuts one of the ends of the handle to provide a smooth transition between the handle and the bumper, the body of the bumper having an outer surface, the cross section of the bumper further including a flange that extends outwardly from the outer surface, whereby the bumper is fixedly secured to the seat back by a plurality of fasteners extending through the flange and into the back member.

4. A chair as set forth in claim 3, wherein handle and bumper each have outer surfaces, the widths of the outer surfaces of the bumper and handle are substantially similar to provide a smooth transition between the handle and the bumper.

5. A chair as set forth in claim 3, wherein the bumper is formed of a resilient material.

6. A chair as set forth in claim 3, wherein the handle and the bumper each have generally circular cross sections.

7. A chair as set forth in claim 3, wherein the body of the bumper is offset relative to the flange in a direction generally transverse to the flange.

8. A chair as set forth in claim 3, wherein the body of the bumper is centered relative to the flange in a direction generally transverse to the flange.

9. A chair as set forth in claim 1, wherein handle and bumper each have outer surfaces, the widths of the outer surfaces of the bumper and handle are substantially similar to provide a smooth transition between the handle and the bumper.

10. A chair as set forth in claim 1, wherein the bumper is formed of a resilient material.

11. A chair as set forth in claim 1, wherein the handle and the bumper each have generally circular cross sections.

12. A chair comprising:

a seat back including a generally rigid back member having a peripheral edge, the peripheral edge defined by spaced apart sides and top and bottom edges extending between the sides;

a handle fixedly secured to the top edge of the scat back, the handle having a nub defined at an end thereof;

a bumper that extends along at least a portion of the peripheral edge, the bumper having an aperture defined at an end thereof, the aperture being adapted for receiving the nub of the handle therein to allow the ends of the handle and bumper to abut to provide a smooth transition between the handle and bumper.

13. A chair as set forth in claim 12, wherein the handle includes an outer surface and the nub has a reduced width relative to the outer surface, an abutment surface being defined due to the difference in width between the outer surface and nub of the handle.

14. A chair as set forth in claim 13, wherein the bumper includes an outer surface that has substantially the same width as the outer surface of the handle, such that when the nub has been received in the aperture of the bumper, the end of the bumper abuts the abutment surface to provide a smooth transition between the handle and bumper.

15. A chair as set forth in claim 12, wherein the back member includes opposite front and rear bides each defined between the peripheral edge, the bumper having a flange that is fixedly secured to the rear side of the back member.

16. A chair as set forth in claim 15, wherein a foam pad is disposed along the front side of the back member.

17. A chair as set forth in claim 16, wherein a trim cover is wrapped substantially around the foam pad, the trim cover having a peripheral edge that is disposed between the flange and the rear side of the back member, whereby the bumper and trim cover are fixedly secured to the seat back by a plurality of fasteners extending through the flange and into the back member.

18. A chair as set forth in claim 17 including a back panel that is fixedly secured to the seat back to substantially conceal the read side of the back member.

19. A chair as set forth in claim 18, wherein the flange of bumper is substantially concealed between the back panel and the rear side of the back member.

20. A chair as set forth in claim 12, wherein the bumper is formed of a resilient material.

21. A chair as set forth in claim 12, wherein the handle and the bumper each have generally circular cross sections.

* * * * *